US010410613B2

(12) United States Patent
Harris

(10) Patent No.: US 10,410,613 B2
(45) Date of Patent: Sep. 10, 2019

(54) FLUTE WITH ENHANCED FLUTE-FINGER CONNECTION

(71) Applicant: David Garland Harris, Manlius, NY (US)

(72) Inventor: David Garland Harris, Manlius, NY (US)

( * ) Notice: Subject to any disclaimer, the term of this patent is extended or adjusted under 35 U.S.C. 154(b) by 0 days.

(21) Appl. No.: 15/870,968

(22) Filed: Jan. 14, 2018

(65) Prior Publication Data

US 2018/0211642 A1 Jul. 26, 2018

Related U.S. Application Data

(60) Provisional application No. 62/446,394, filed on Jan. 14, 2017.

(51) Int. Cl.

| | |
|---|---|
| ***G10G 5/00*** | (2006.01) |
| ***G10D 9/04*** | (2006.01) |
| ***G10D 7/02*** | (2006.01) |

(52) U.S. Cl.
CPC ..... *G10G 5/005* (2013.01); *G10D 7/026* (2013.01); *G10D 9/043* (2013.01)

(58) Field of Classification Search
CPC ..... G10D 9/043; G10D 7/026; G10G 5/005
See application file for complete search history.

(56) References Cited

U.S. PATENT DOCUMENTS 4,909,123 A * 3/1990 Butenschon, III ..... G09B 15/06 84/382

* cited by examiner

*Primary Examiner* — Kimberly R Lockett

(57) ABSTRACT

This invention relates to new designs of tubular body flutes both to facilitate more natural and more consistent placement and orientation of the flute player's hands and to enhance the flexibility of the player's lips so as to more perfectly play the flute by greatly increasing the stability of the flute in the player's hands by firmly connecting the flute to the player's finger (and/or thumb) by provision of a finger connecting part through which the flute player's left index finger is inserted, as like wearing a ring. It firmly fixes the flute to the player's left index finger (and/or thumb) so that the flute is stabilized without pressure on the player's mouth. Thus, it enhances the flexibility of the player's lips to more perfectly form the airstream sounding the flute while also more exactly and repeatedly locating the player's fingers on the flute by preventing inadvertent rotation of the flute. This is especially beneficial for the player's lower lip, which, under extant art, is forcibly pinned against the lower teeth and gums so as to stabilize the flute. This benefit is achieved by completely stabilizing the flute in the player's hands by firmly connecting the flute to the player's finger (and/or thumb) with a finger connecting means incorporating an opening in the invention through which the flute player's left index finger (and/or thumb) is inserted, as like wearing a ring.

In the preferred embodiment the finger connecting means is a ring-like structure built onto the flute and for economy this additional device is hereafter referred to as a ring. The use of a ring provides a firm connection between the player's fingers and the flute permitting the left index finger and right thumb to completely stabilize the instrument with no pressure on the player's lips whatsoever, while completely preventing inadvertent rotation of the flute.

A very substantial benefit of the instant invention over extant art is that it allows the flute to be safely played by growing children without disrupting the proper development of their gums and teeth. Many parents permit their children to start their music education only with a piano or a violin because wind instruments have a tendency to put severe stress and strain on the mouth, teeth and gums, which can distort their development. Because the instant invention permits, even encourages, the best use of the flute without strong, or even (Continued)

any, pressure on the teeth and gums, a flute so equipped can be used even by young children without orthodontial concerns.

15 Claims, 11 Drawing Sheets

FLUTE WITH ENHANCED FLUTE-FINGER CONNECTION

CROSS-REFERENCE TO RELATED APPLICATIONS

This application claims the benefits and priority of Provisional Patent Application, 62/446,394, filed at 14:14:01 EST on 14 Jan. 2017, by the present inventor, which is incorporated by reference.

FEDERALLY SPONSORED RESEARCH

None.

SEQUENCE LISTING

None.

A very substantial benefit of the instant invention over extant art is that it allows the flute to be safely played by growing children without disrupting the proper development of their gums and teeth. Many parents permit their children to start their music education only with a piano or a violin because wind instruments have a tendency to put severe stress and strain on the mouth, teeth and gums, which can distort their development. Because the instant invention permits, even encourages, use of the flute without strong, or even any, pressure on the teeth and gums, a flute so equipped can be used even by young children without orthodontia concerns.

BACKGROUND ART

A recurring problem in playing the flute is the awkward positioning required of the hands and fingers for the proper control and operation of the musical instrument, which has an innate tendency to roll because of imbalance from the weight of the keys and other parts of the flute's operating system. Because the player must rapidly shift fingerings between all keys of the flute being depressed to some or all keys being open, producing radically changing support of the flute from the player's fingers, the stability of the flute is imperiled. This instability is reflected both in the difficulty of maintaining the ideal relation between the lips and the flute so as to produce the most perfectly formed notes and in the difficulty of changing fingerings quickly and reliably while also preventing the flute's rolling away from its ideal position.

Per the current state of the art, to stabilize the flute force is applied by the side of the left index finger that in turn transfers appropriate pressure of the flute mouthpiece against the flute player's lower lip. To create this pressure, the digits of the right hand press the flute outward, which, via the base of the left hand index finger acting as a fulcrum, transfers pressure to the player's lower lip. To hold the flute so as to avoid untoward movement of the instrument considerable pressure must be exerted. Maintaining such substantial, constant, balanced, stabilizing pressure, given the rapid and extreme variations in support provided by the player's fingers as different notes are played, is problematic and not always successfully accomplished, leading to the flute rolling about, and incorrect and/or poor quality notes being played.

A variety of hand-positioning techniques are advocated in the literature for better stabilizing the flute against unintended rolling, such as the Rockstro hand position. None of these prescriptions serve other than to reduce the flute's instability a bit, and a serious drawback of current flute playing techniques and all extant prescriptions for mitigating this difficulty is the need for substantial pressure to be exerted by the flute mouthpiece against the player's lower lip. For example, the Rockstro hand position is based on considerable additional pressure being applied by the player's right thumb to the side of the flute nearest the player, more forcefully leveraging it against the fulcrum of the base of the index finger, which contacts the flute's side furthest from the player, creating substantial pressure against the player's lower lip sufficient to more firmly fix the position of the flute and reduce its rolling in the player's hands. Such hand positions evidence several problems. First, they require an awkward and unnatural positioning of the thumb. The thumb is much more naturally positioned on the bottom of the flute than against its side, which can be done with this invention without any loss of control of the flute. Second, such hand positions require substantial steady pressure, which is difficult to maintain when moving the other fingers of the right hand, and which is exacerbated by the fatiguing hand position noted above. Third, the substantial pressure against the base of the index finger of the left hand is painful and fatiguing after a time, both limiting continuous practice and performance time and being a cause of playing errors. The necessary pressure is so great that it is common, if not universal, among experienced flute players for a substantial callus to form on their left hand at the point where the base of index finger presses against the flute. Fourth, and most problematic, such hand positions rely upon even greater pressure being applied by the flute to the player's lower lip, limiting the flexibility of the lips to shape and form notes in the most ideal way, which is especially problematic given the need of a flute player to widely, flexibly and quickly alter the shape of their lips, their embouchure, in order to best play all of the notes of the flute.

The provision of solid, stable flute-finger and flute-thumb connectors, finger retainers, permits much more stable and certain control of the flute, no matter the complexity of fingering any sequence of notes. When using both the index finger and right thumb connectors it is possible to operate the keys and retain control of the flute with no pressure on the lower lip or the base of the left index finger whatsoever and with no other body parts of the player in contact with the instrument. This stabilizing support being independent of operating the flute permits finger changes for any sequence of notes with little or no effect on the stability of the flute or its position relative to the player's lips.

That is, this additional stabilizing support does more than prevent rotation. It also provides material support in the vertical and horizontal dimensions, as shown by the ability of one to hold and operate a flute with this device without any contact with their lips.

Separating the amount of pressure applied to the player's lower lip from operating, controlling, and stabilizing the flute permits the player to completely flexibly employ both the lower lip and the upper lip so as to create the most pleasing notes possible. Even beyond this very substantial benefit is the effect of the instant invention of providing absolutely greater stability and control of the instrument, thereby facilitating quicker, more accurate and more consistent complex fingering changes both by reducing pressure on critical fingers and by generally increasing the stability of the instrument in the player's hands. Similarly, with less pressure required, playing the flute for an extended time period is less fatiguing and painful. Also, provision of a ring allows more consistent, repeatable and quickly attained positioning of the hands on the flute; one need only put the left index finger into the ring to quickly locate the left had in exactly the same, consistent, and correct position.

Another very substantial benefit of the instant invention over extant art is that it allows the flute to be safely played by children without fear of distorting the proper development of their gums and teeth. Many parents permit their children to start their music education only with a piano or a violin because wind instruments generally put severe stress and strain on the mouth, teeth and gums, which can distort their development. Because the instant invention permits, even encourages, the best use of the flute to be without strong, or even any, pressure on the teeth and gums, a flute so equipped can be used even by young children without orthodontia concerns.

Prior art in this area does not address the manufacture of new flutes, but consists only of add-on aftermarket enhancements to the flute. Additionally, prior art does not anticipate or even imply the enhancements comprising the important contributions to the art of the instant invention. Tanabe, U.S. Pat. No. 8,269,086 B1, provides a ring for the player's finger with friction pads that touch the flute. However, this device only helps to create some additional friction between the player's hand and the flute, but does not serve to fix that relation in any definite or necessary way, and neither does it reduce substantially the pressure against the player's lower lip needed to stabilize the flute. For example, the instant device of the current invention is so stable that a player can hold the flute utilizing only the left index finger and the thumb of the right hand, and without touching the flute to their chin or lips, as the current invention allows the player to otherwise support the flute without the use of any other fingers or pressure points. Additionally, Tanabe's device does not establish the consistent placement of the player's hand in relation to the flute because it is not fixed to the flute, but to the player's hands. Because the flute-finger connector of the instant invention is part of the flute, when the player removes their hands, the flute can be re-deployed instantly by merely inserting the correct digits into the ring-openings and playing.

Peplowski, U.S. Pat. No. 4,763,556 provides a rest and spacer for the index finger of the left hand and a similar rest for the thumb of the right hand. Ho Fan Lee, patent application Ser. No. 11/349,197, provides a somewhat similar device to that of Peplowski, but with a small amount of additional support for the thumb of the right hand. While both devices assist in proper placement of the hands, and in permitting better playing, neither addresses the inherent instability of the flute caused by the various shifting fingerings and the lack of secure connection between the player and the flute which results in the flute rolling about as the player changes fingerings to produce various notes. Thus, the current invention differs from these both by provision of a stability enhancing connecting device between the player's digits and flute and by, in some embodiments, omitting any spacer.

Guenther, U.S. Pat. No.444,830 A shows a vertically-played flute with hooks provided for the player's thumbs so as to better hold the flute in that position. This arrangement is common for vertically-played instruments such as clarinets, bassoons, etc. The instant invention is quite novel with respect to these devices as they would not function as it does with a transversely played flute. They serve only to prevent the downward movement of an instrument when it is held vertically and would serve no purpose with a transverse instrument.

Harris, in contemporaneous art, Provisional Patent Application, 62/446,401, filed at 15:20:22 Eastern Time on 14 Jan. 2017, discloses a related device. That PPA does not relate to newly manufactured flutes, but discloses an add-on enhancement to existing flutes which allows them to enjoy some of the benefits of the instant invention. In that application is described an attachment to existing flutes comprising a flute-finger connector of a ring, or partial ring, mounted on a pad. The pad is critical to this device as it both provides better conformation with the physiology of the player's hand for greater comfort, and also is a spacer of some thickness such that the player's hand is positioned at a more comfortable angle with respect to the flute, permitting more effective and less fatiguing operation of the flute. This device is removably attachable to an existing flute in a variety of ways, a number of which are shown in the PPA.

Harris, in contemporaneous art, Provisional Patent Application, 62/446,407, filed at 16:25:14 EST on 14 Jan. 2017, discloses a related device. That PPA does not relate to newly manufactured flutes, but discloses an add-on enhancement to existing flutes which allows them to enjoy some of the benefits of the instant invention. In that application is described an attachment to existing flutes comprising a flute-finger connector of a discontinuous ring mounted on arms running parallel to the flute, removably attachable to an existing flute in a variety of ways, a number of which are shown in the PPA. This device does not have a built in finger rest or spacer for offsetting the player's left hand. Omitting a spacer/finger rest is important in that this device permits the player's left hand to operate the flute exactly how it would have been operated without the device because the player's left index finger rests on the flute itself. This enhances the ability of players to adopt this enhancement with minimal change in their playing techniques.

Whereas contemporaneous and prior art consists only of add-on aftermarket enhancements to existing flutes, the instant device is integrally built into the flute during its manufacture. Thus, not only can the most effective enhancements most cost-effectively be incorporated into the flute's design and construction, but it can be done in a more beautiful, integrated fashion with no unusual or undesirable effects on the flute's appearance or function. For example, any removably attachable device may become removable at an inopportune moment, or shift about. In contrast, an enhancement built as part and parcel of the flute itself will not do so. Also, incorporating a flute-finger connector into the flute itself should not only provide the most solid mount, but, as no extraneous attachment mechanisms are used, scarring and scratching the flute from putting things onto and off of it is avoided.

OBJECT OF THE INVENTION

It is therefore an object of the present invention to provide a new design of tubular body flutes which permits stabilizing the flute without undue, or even any, pressure on the player's lower lip and also facilitating complex fingering changes by greatly enhancing the inherent stability of the flute, independent of its operation.

DISCLOSURE OF THE INVENTION

In order to accomplish these results, the present invention, in the preferred embodiment, provides a round tubular flute body with a flute-finger connector, a ring-like fixture, located where the left index finger of a flute player rests against the flute body when playing the flute. This may be incorporated in the flute's manufacture with or without an integral supporting pad, or raised portion of the flute where the player's left index finger rests against the flute.

In a preferred embodiment, the flute-finger connector ring provides substantial stability and anti-rotational force on the flute while, at the same time, the left index finger is free to perform the multiple functions of pivot point, pressure point, and upper C key operations. In addition, the player's right hand is more naturally and comfortably located, facilitating improved operation of the flute.

According to another embodiment of the invention, the flute-finger connector, for example a ring or a clip, is provided on the lower surface of the round tubular flute body between the E and F tone holes of the flute where the right thumb of a flute player rests against the flute body when playing the flute. An appropriate ring or other retention device, such as a ring or a clip into which the tip of the thumb may be inserted, is provided there so as to stabilize the flute with the thumb in a natural position.

DESCRIPTION OF PREFERRED EXAMPLE EMBODIMENTS AND BEST MODE OF THE INVENTION

Figure 1:
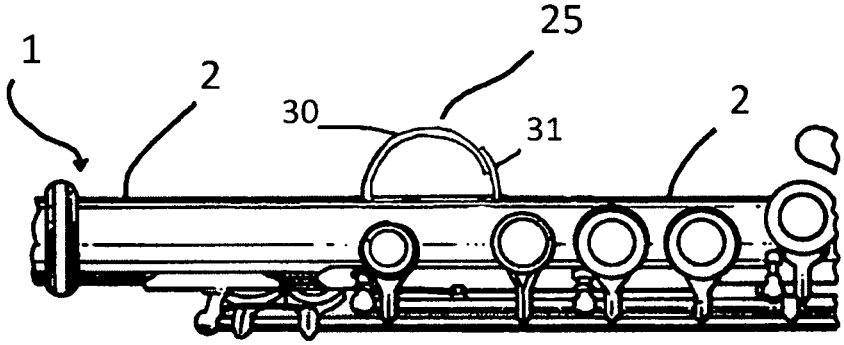
FIG. 1 is a fragmentary top view of a flute, 1, with an adjustable ring-like flute-finger connector, finger retainer, 30, comprising adjustable arms, 25 and 31, placed between the upper C# tone hole and upper C finger key on the tubular body, 2, of the flute.
Figure 1A:
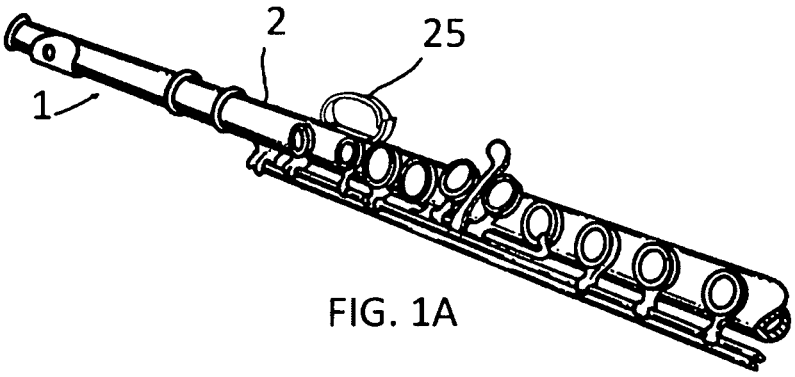
FIG. 1A is a more distant fragmentary environmental perspective view of the flute, 1, in the direction of the flute head showing the adjustable ring-like flute-finger connector, 25, in relation to the flute.
Figure 2:
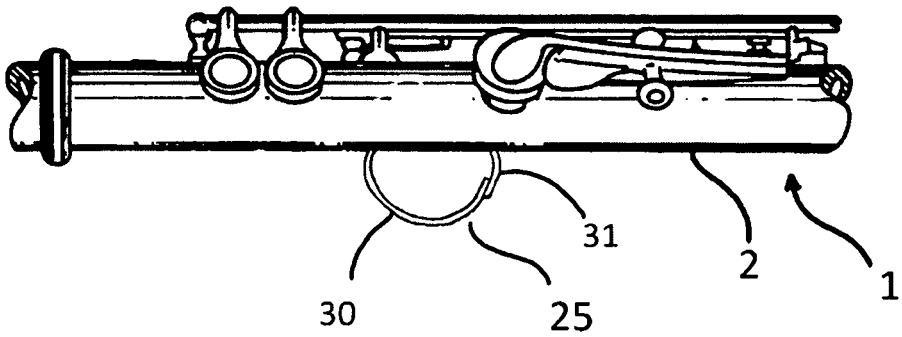
FIG. 2 is a fragmentary view of the flute of FIG. 1A from the side opposite that shown in FIG. 1A showing the same flute-finger connector adjustable ring-like device, 25.
Figure 2A:
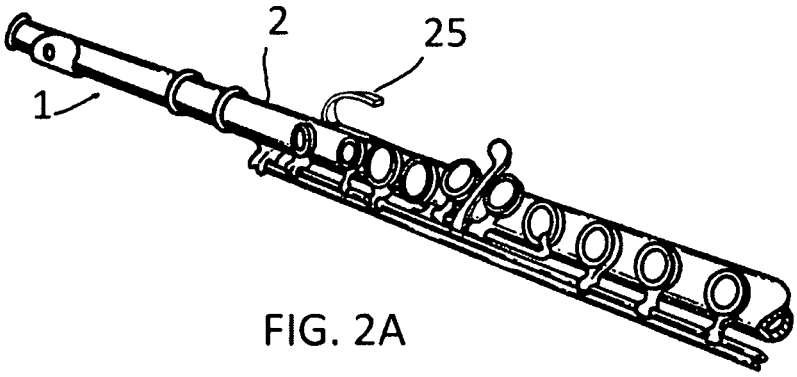
FIG. 2A is a more distant fragmentary environmental perspective view of the flute in the direction of the flute head showing the adjustable ring-like flute-finger connector which, in this example, comprises only a partial ring and a single, adjustable arm.

In FIG. 1 is shown a flute, 1, in the tubular body of which, 2, is constructed a flute-finger connector adjustable ring, 25, which the size of the opening therein is adjusted by bending the malleable arms of the ring, 30 and 31. FIG. 1A shows the same embodiment of the invention from a more distant perspective view. FIG. 2 shows the same from the back side of the flute. FIG. 2A shows the same view of a flute with a flute-finger connector as in FIG. 1A, but with a flute-finger connector comprising only a single, malleable, adjustable arm, 25 which does not fully encircle the player's left index finger.

Figure 3:
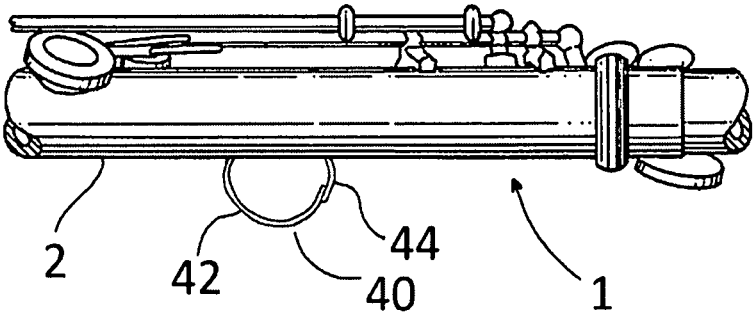
FIG. 3 is a fragmentary view of the back of a flute with an adjustable-size flute-finger connector ring placed between the E and F finger keys, for stabilizing the flute by its connection with the player's thumb.
Figure 4:
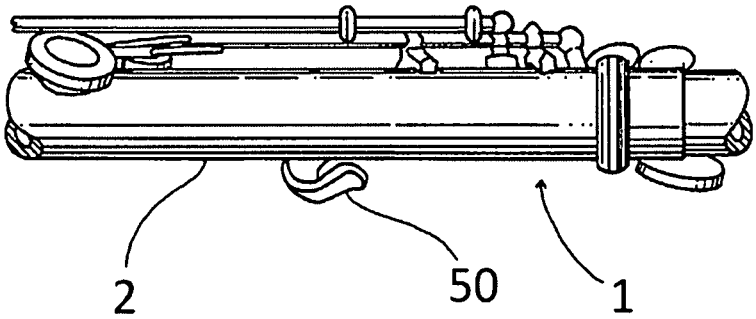
FIG. 4 is a fragmentary view of the back of a flute with flute-finger connector comprising a clip placed between the E and F finger keys, for stabilizing the flute by its connection with the player's thumb.

FIG. 3 shows a flute-thumb connector, 40, similar to that described and illustrated above in FIGS. 1 to 2, but, located on the lower part of the flute between the E and F keys, where the thumb of the player's right hand rests. As above, it is an adjustable ring, which the size of the opening therein is adjusted by bending the malleable arms of the ring, 42 and 44. FIG. 4 shows a flute-finger connector for the thumb comprising a clip, 50, which can be made of adjustable, malleable material.

Figure 5:
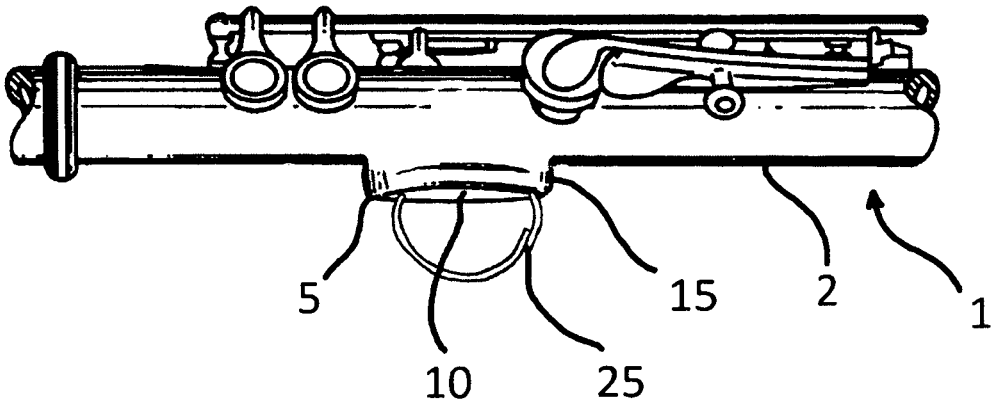
FIG. 5 is a fragmentary view of the flute from the back side showing the flute-finger connector adjustable ring-like device constructed as part of an integral, raised pad, 10, constructed as part of the flute.
Figure 6:
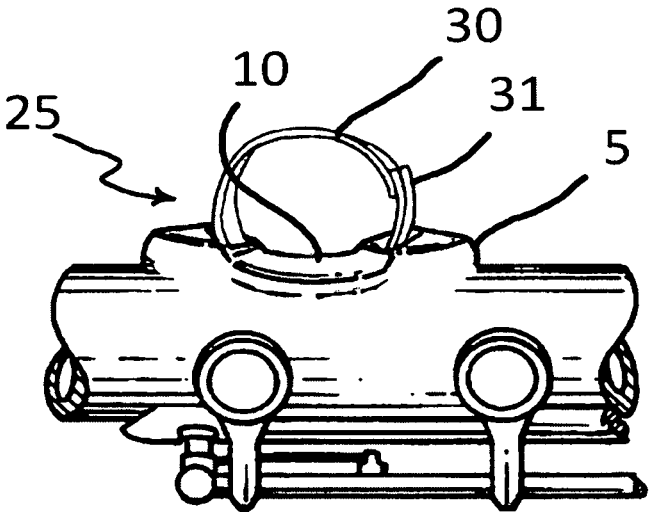
FIG. 6 is a fragmentary view of the flute from the front side showing the flute-finger connector adjustable ring-like device constructed as part of an integral, raised pad constructed as part of the flute; said pad being constructed with an ergonomically shaped surface to better accommodate the base of the player's left index finger.

FIG. 5 and FIG. 6 show a flute as in FIG. 1 with a flute-finger connector adjustable ring, 25, built into a spacer/pad, 5. In FIG. 5 it has a flat surface, 10, and a thickness to its sides, 15, and in FIG. 6, it has a curved surface, 10.

Figure 7:
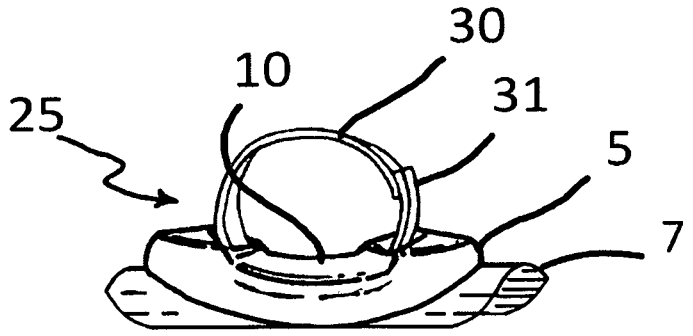
FIG. 7 shows a flute-finger connector size-adjustable ring that is positionally adjustable when mounted on the flute. This can be affixed to the flute with integral mounts on the flute which permit it to be moved along and around the tubular body of the flute. It can also be removed and the flute played exactly as it would have been without a flute-finger connector, so long as the integral mounts on the flute are sufficiently spaced apart. The base of this part can be made in a variety of shapes and sizes so as to enhance the stability of the flute while also permitting its movement without interfering with the operation of the flute's keys.
Figure 8:
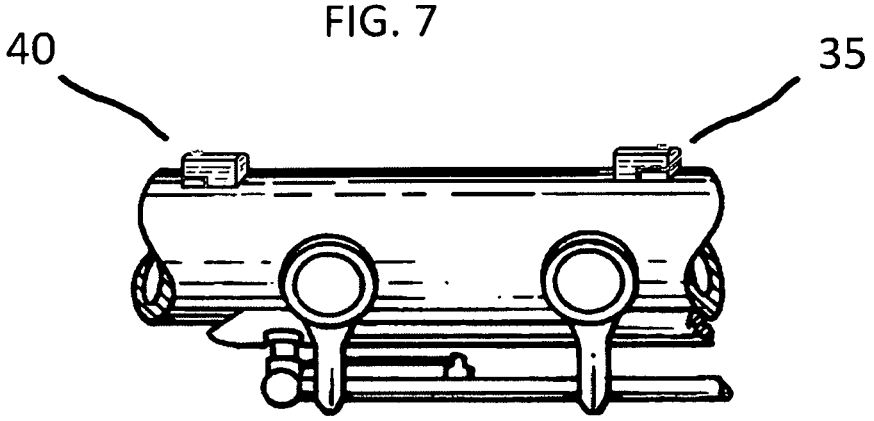
FIG. 8 is a partial view of a flute manufactured with mounts to receive and affix the adjustable flute-finger connector of FIG. 7 to the flute.
Figure 9:
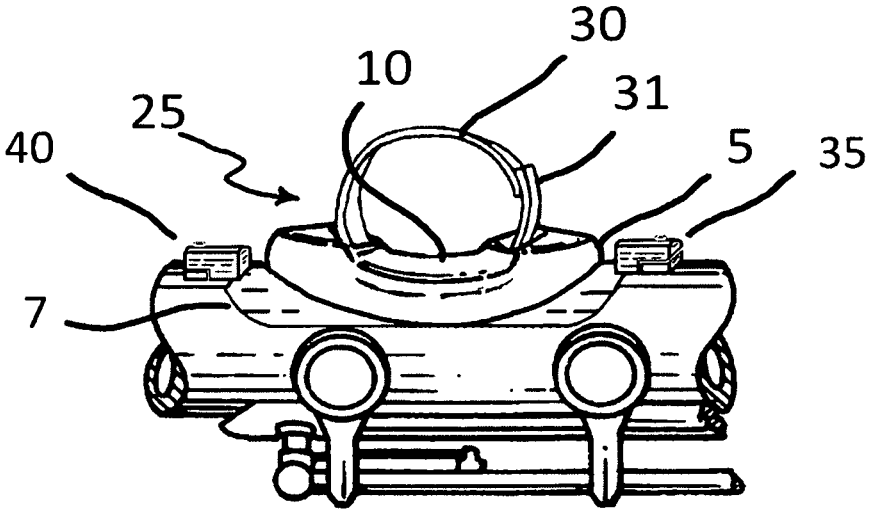
FIG. 9 is a partial view of the adjustable flute-finger connector mounted on the flute.

To accommodate players with fingers and hands of widely varying sizes and configurations, FIGS. 7-11 show a system for mounting a removable and adjustable flute-finger connector permitting the player to more exactly adjust the position of the device so as to best accommodate their specific needs. FIG. 7 shows a view of an adjustable flute-finger connector with a finger-rest spacer/pad as in FIG. 1, but which is removable from the flute. This is made removable and adjustable by provision of a plate, 7, shaped to conform to the tubular body of the flute which is attached to, manufactured as a part of, the base of the device, 5. When the invention, via its base plate, 7, is attached to the flute, the mounting blocks, 35 and 40, as shown in FIG. 8, provide frictional pressure on the plate, affixing it removably and adjustably to the body of the flute. Thus, the flute-finger connector can be adjusted in all directions before being tightened into place, as shown in FIG. 9.

Figure 10:
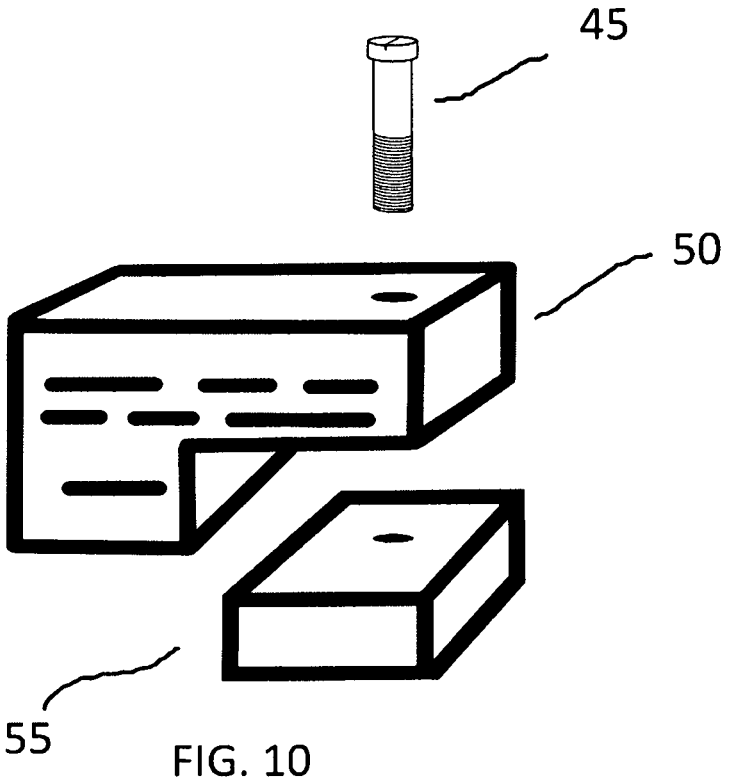
FIG. 10 is a detailed view of the parts of the mounting apparatus.
Figure 11:
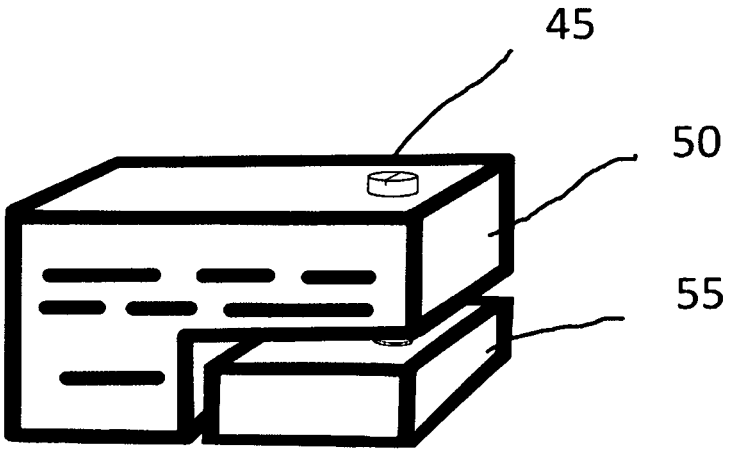
FIG. 11 is a detailed view of the assembled mounting apparatus.
Figure 12:
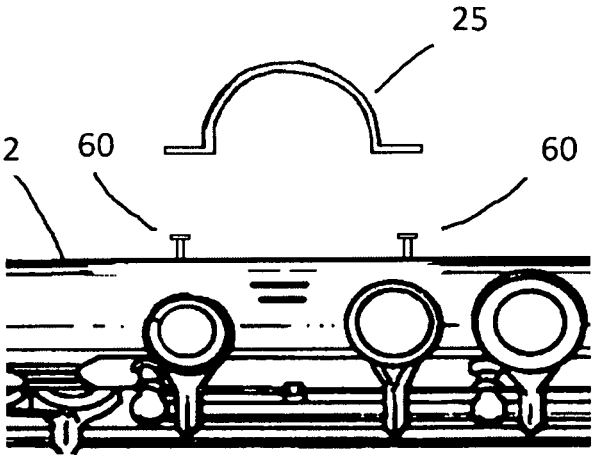
FIG. 12 is a partial view of a flute with another embodiment of the invention. In this instance, the flute-finger connector is attached to the flute via pegs that fit matching notches in the flute-finger connecting partial ring.
Figure 13:
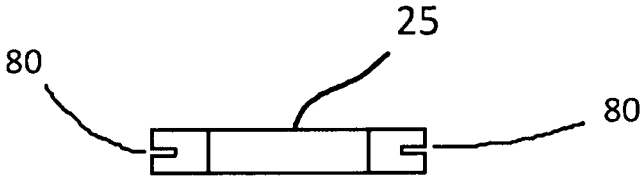
FIG. 13 shows a view from the top of the flute-finger connector partial ring showing its notches that fit corresponding pegs on the body of the flute. With this arrangement, rigid, continuous, flute-finger connectors of varying sizes may be fit to the flute so as to accommodate a variety of players' hands.
Figure 14:
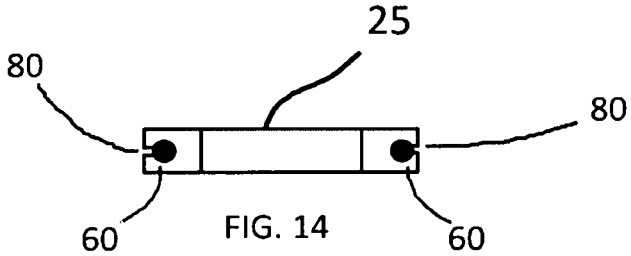
FIG. 14 shows a view from the top of the flute-finger connector partial ring showing its notches when engaged with the corresponding pegs on the body of the flute.
Figure 15:
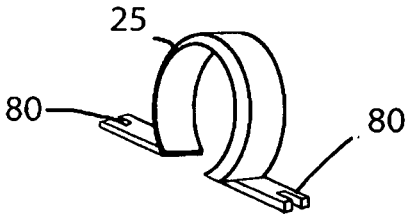
FIG. 15 is a perspective view of the flute-finger connector partial ring of FIGS. 12-14.

FIG. 10 provides a detailed view of the parts of the mounting block, 35. It comprises a tensioning screw, 45, a piece which provides pressure on the flute-finger connector base via an upper block, 50, when the screw, 45, is tightened into the lug, 55, which is a permanent non-removable part of the flute. FIG. 11 shows the assembled mounting block, 40, as it would appear on the flute when pressing down on and holding the device in place.

FIGS. 12-23 show a variety of alternative embodiments of the invention, though not necessarily the entire range of possibilities, and functionally equivalent modes are encompassed by the scope of the claims, below.

FIGS. 12-15 depict an alternative embodiment of the invention for mounting a flute-finger connector non-adjustable ring to the flute. By squeezing the sides of the flute-finger connector ring, 25, it can be fitted between the pegs, 60, built onto the body of the flute. Releasing this tension so that the notches, 80, in the flute-finger connector ring tightly mate with the pegs, 60, on the flute firmly, but removably, locks the ring to the flute. This system can accommodate a variety of players by simply substituting flute-finger connector rings with different sized openings.

Figure 16:
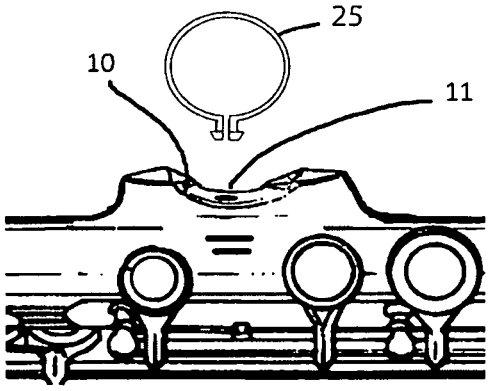
FIG. 16 shows a partial view of a flute with another embodiment of the flute-finger connector partial ring which fits into a properly sized opening in the body of the flute. This flute-finger connector partial ring is rotatable, and can be replaced with devices of various sizes so as to accommodate a variety of players' hands.

FIG. 16 depicts an alternative embodiment of the invention for mounting a rotatable flute-finger connector non-adjustable ring to the flute. By squeezing the sides of the flute-finger connector ring, 25, it can be fitted into the properly formed opening in the flute, 11, built onto the body of the flute. Releasing this tension expands the bottom of the device, locking the flute-finger connector ring removably, but firmly, to the flute. This system can accommodate a variety of players by simply substituting flute-finger connector rings with different sized openings.

Figure 17:
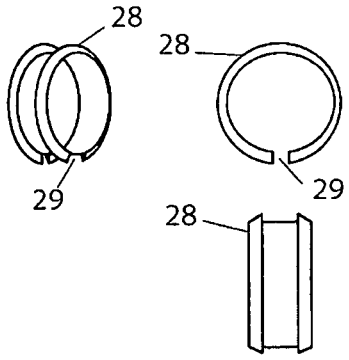
FIG. 17 shows several views of a size-adjusting ring which can be utilized with any of the devices shown herein. That is, by varying the thickness of this ring and inserting it into the ring-openings of the invention; they can be adjusted thereby to accommodate a variety of players' hands.

FIG. 17 depicts several views of a ring, 28, that can be inserted into any non-adjustable flute-finger connector ring to reduce the size of its opening. This size-adjusting ring is of memory retaining material that can be compressed and inserted into a non-adjustable ring, which, after re-expanding, locks it firmly, but removably, into place. That is, many of the embodiments disclosed herein show adjustable rings, which could also be replaced with non-adjustable rings. In such case, a size-adjusting ring, as shown in FIG. 17, can be inserted into the non-adjustable ring, assuming that it was made of sufficiently large size, so as to reduce the size of its opening in order to fit a variety of players' hands. This can be fit to any number of configurations by varying the thickness of the ring and the size of the gap in the ring, 29.

Figure 18:
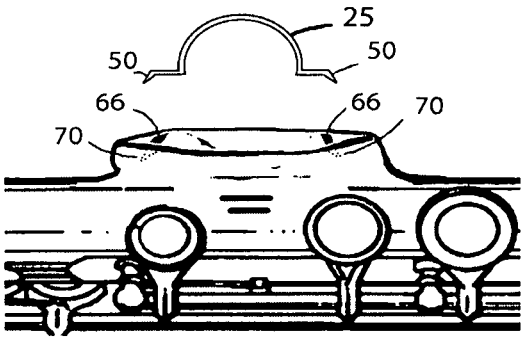
FIG. 18 is a partial view of a flute with another embodiment of the invention. In this instance, the flute-finger connector is attached to the flute via hooks that fit into matching openings in the flute, in this case, shown in conjunction with a raised pad built into the flute.
Figure 19:
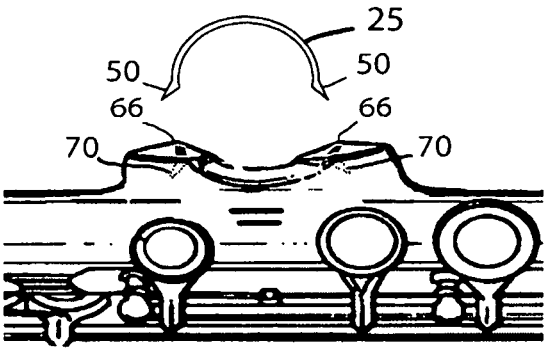
FIG. 19 is a partial view of a flute as in FIG. 18. In this instance, a flute-finger connector larger than is shown in FIG. 18 is attached to the flute via hooks that fit into matching openings in the flute, in this case, shown in conjunction with a raised pad and ergonomically designed resting surface for the index finger built into the flute.

FIGS. 18 and 19 show an embodiment of the invention in which the flute-finger connector ring, 25, fastens to the body of the flute via hooks, 50, on the base of the ring, which fit openings in the body of the flute, 66, and into cuts in the body, 70. Comparing the size of the flute-finger connecting ring in FIG. 18 with that in FIG. 19 shows how larger and smaller rings can be accommodated by the same receiving mechanism built into the flute.

Figure 20:
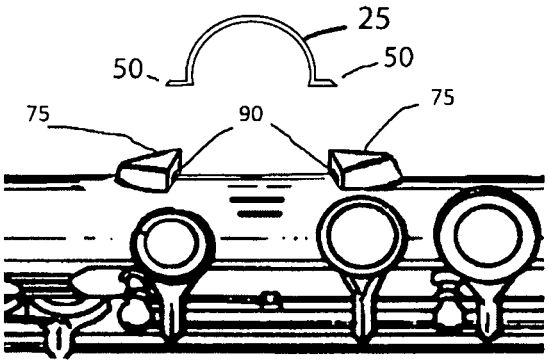
FIG. 20 is a partial view of a flute with another embodiment of the invention. In this instance, the flute-finger connector is attached to the flute via extensions or arms at its base that fit into matching openings in flanges built into the flute. This permits the flute-finger connector to thereby to accommodate a variety of players' hands simply by using different size rings.

FIG. 20 shows an embodiment of the invention, analogous to FIGS. 18 and 19, but without a raised pad into which to fasten the ring's hooks. In this case, mounting flanges are built into the flute with openings, 90, into which the ends of the base of the ring, 50, can be fit.

Figure 21:
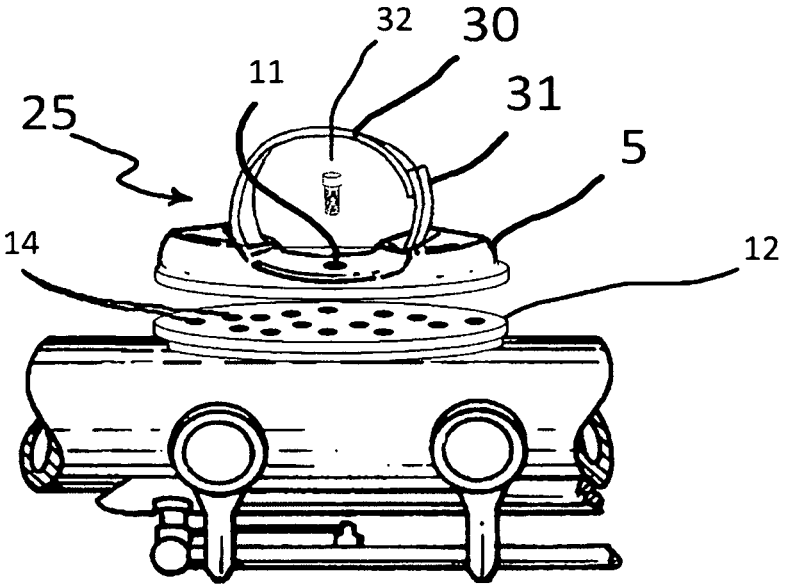
FIG. 21 is a partial view of a flute with another embodiment of the invention. In this instance, the flute-finger connector is affixed to the flute via screw attachment onto a mounting plate provided with numerous threaded holes. The flute-finger connector has adjustable arms, but could also be made with any of the other designs discussed herein, and is rotatable around the mounting screw. This mounting system permits the device's location on the flute to be adjusted so as to accommodate a variety of players' hands.

FIG. 21 shows an embodiment of the invention which provides not only for an adjustable flute-finger connector ring, 25, but for substantial adjustability along and about the body of the flute. Built onto the body of the flute is a base plate, 12, into which are manufactured a number of threaded holes, 14, which fit the mounting screw, 32. The mounting screw, 32, binds the base of the flute-finger connector, 5, to the mounting plate of the flute, 12. By selecting different holes in the base plat for mounting, the device is adjustable about the flute. Also, the device can be rotated around the screw, 32, no matter which hole it is mounted in, permitting another dimension of adjustability.

Figure 22:
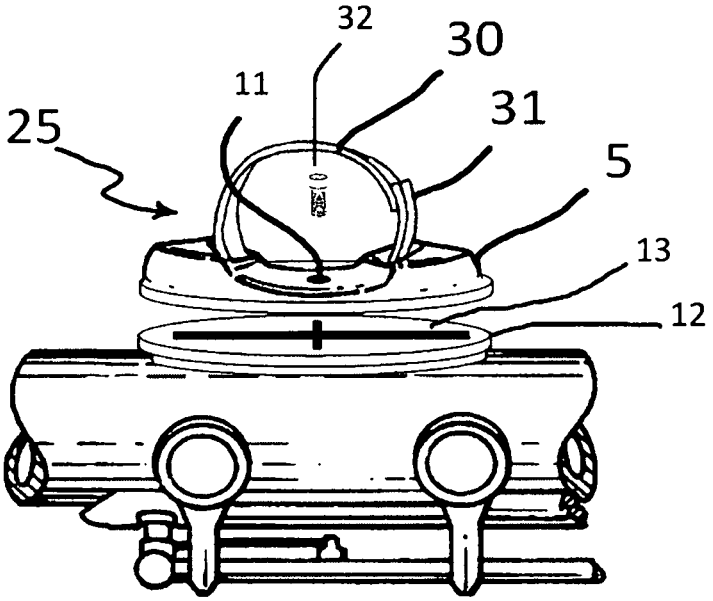
FIG. 22 is a partial view of a flute with another embodiment of the invention. In this instance, the flute-finger connector is attached to the flute via being screwed through a mounting plate into a movable nut. The mounting plate has machined into it slots with interior stepped sides that retain the nut while also permitting the assembly to slid along the slots. The flute-finger connector has adjustable arms, but could also be made with any of the other designs discussed herein, and is rotatable around the mounting screw. When loosely screwed into the nut, the flute-finger connector device can be moved along the slots in the mounting plate and rotated around the mounting screw. When tightened down it is locked into position. This mounting system permits the device's location on the flute to be adjusted so as to accommodate a variety of players' hands.
Figure 23:
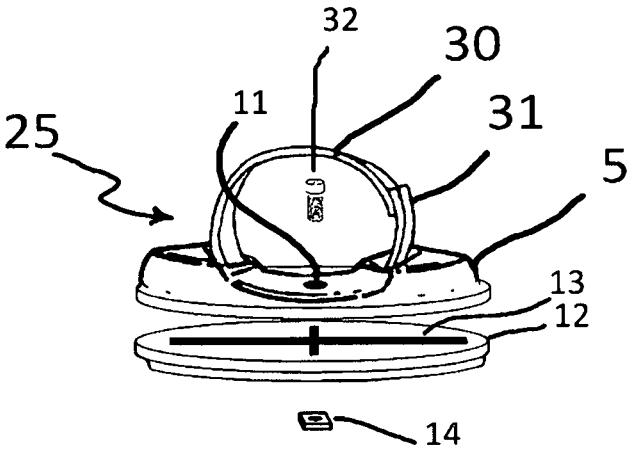
FIG. 23 is a detailed view of the parts of the device shown in FIG. 22 before it would be built into the flute.

FIGS. 22 and 23 show an embodiment similar to FIG. 21, but with its adjustability about the flute being continuous along either of two axes. Here, the mounting screw, 32, passes through an opening in the base place, 12, to engage a nut, FIG. 23, 14. The slots in the base plate are step machined inside so that the when only loosely connected, the nut and the flute-finger connector can be moved along the slots. Also, the device can be rotated around the mounting screw, 32.

Figure 24:
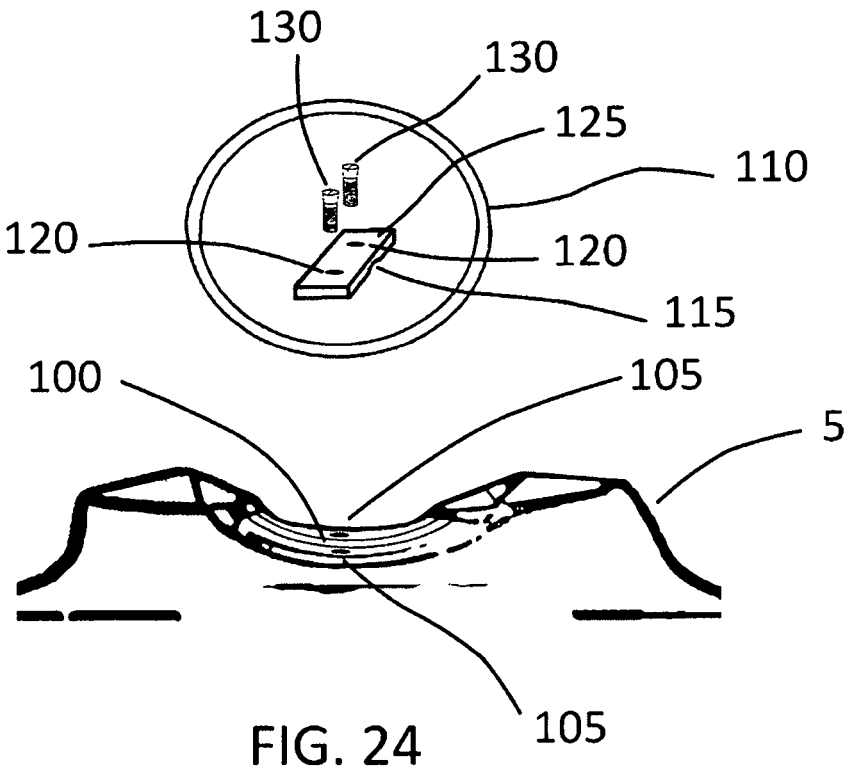
FIG. 24 is a fragmentary view of a flute as in FIG. 6, but without an integrally manufactured ring. This figure is of a flute manufactured so as to accept and removably retain rings, in general.

FIG. 24 shows a fragmentary view of a flute as in FIG. 6, but without an integrally manufactured ring. Rather, the flute in FIG. 24 is an example of an embodiment of the invention which can accept and removably retain rings, in general. The flute in FIG. 24 comprises an integrally manufactured raised finger-connector base, 5, which has two threaded holes in it, 105, which fit two matching screws, 130. The base also has formed in it a groove, 100, to accept the outside, downward edge, of a ring, 110. In this example the ring, 110, is a plain band, but this groove could be manufactured to fit any ring, including decorative rings. The ring, 110, is attached to the flute via a pressure plate, 125, which has a groove in the bottom of it, 120, to accept the inside edge of the ring, 110. The pressure plate also has two holes in it, 120, through which screws, 130, pass to fasten firmly to the base, 5, via the holes in the base, 105. When installed on the flute base, 5, the ring, 110, is sandwiched between the groove, 120, in the pressure plate, 125, and the groove, 100, in the base, 5, firmly, but removably, connecting the ring to the flute.

While the invention has been described with reference to particular example embodiments, it is intended to cover all modifications and equivalence within the scope of the claims below. For example, though specific embodiments of the invention include ring-like finger-connectors with adjustable arms many other variations can also fall within this description such as, solid rings, such as commonly worn as jewelry; rings with adjustable arms comprising hooks and loops, simple ties, or sliding clamps, etc. The ring could be formed of rigid or flexible material, even such as cloth or rubber or leather straps. Similarly, though only particular adjustable flute-finger connectors are described, any device manufactured as part of the flute and achieving the same effect would also fall within the descriptions and claims herein.

I claim:

1. A flute having a round tubular body formed with toneholes, and/or keys, and a flute-finger connector, or finger retainer, comprising a ring which partially or wholly encircles the flute player's left index finger to partially immobilize and solidly connect the flute player's finger to the flute; constructed as part of the flute and located thereon where a player's left index finger rests against the flute when playing the flute, to retain a player's left index finger in fixed relation to the flute and to facilitate the multiple functions of the left index finger, as a pivot point, pressure point, and operating finger for playing the instrument, thereby providing rotational and other stabilizing support of the flute by the player while permitting the left index finger to perform said multiple functions.

2. The flute attachment of claim 1 wherein the left index finger retainer is partial and not continuous.

3. The flute attachment of claim 1 wherein the left index finger retainer is adjustable with respect to its diameter.

4. The flute attachment of claim 1 wherein the left index finger retainer is movably attached to the flute so that it can be rotated around its axis perpendicular to the tubular body of the flute and/or is adjustable as to its angle in relation to a plane which bisects the tubular body of the flute and the finger retainer and which then can be temporarily or permanently fixed in position.

5. The flute attachment of claim 1 wherein the flute-finger connector is attached to the flute so that it can be moved along and around the tubular to body of the flute and which then can be temporarily, or permanently, fixed in location.

6. The flute of claim 1 wherein the finger retainer is removable and replaceable with finger retainers of different materials, thicknesses, and diameters.

7. The flute of claim 1 wherein the finger retainer can receive insert rings of varying thickness to reduce its diameter.

8. The flute of claim 1, constructed without an integral finger retainer, but which can accept and removably retain rings.

9. The flute of claim 1 wherein said finger retainer is a thumb retainer for encircling or enclosing and retaining the flute player's right thumb, located on the flute where the thumb rests when playing the flute.

10. The flute of claim 9 wherein said thumb retainer is removably attached to the flute and is interchangeable with thumb retainers of different sizes.

11. The flute of claim 9 wherein said thumb retainer is adjustable with respect to the size of the opening into which the thumb is inserted.

12. The flute of claim 9 wherein said thumb retainer is movably attached to the flute so that it can be rotated around its axis perpendicular to the tubular body of the flute.

13. The flute attachment of claim 9 wherein the flute-finger connector is movably attached to the flute so that it can be moved along and around the tubular body of the flute and which then can be temporarily, or permanently, fixed in location.

14. The flute attachment of claim 9 wherein the finger retainer is movably attached to the flute so that it can be rotated around its axis perpendicular to the tubular body of the flute and/or is adjustable as to its angle in relation to a plane which bisects the length of the tubular body of the flute and the finger retainer and which then can be temporarily or permanently fixed in position.

15. The flute of claim 1, wherein the finger retainer is of fixed diameter, and accepts inserts to reduce its diameter.

* * * * *